US005935920A

United States Patent [19]

Geke et al.

[11] Patent Number: 5,935,920

[45] Date of Patent: Aug. 10, 1999

[54] CLEANER WITH HIGH WETTING POWER

[75] Inventors: Juergen Geke; Friedbert Zetzsche, both of Duesseldorf, Germany

[73] Assignee: Henkel Kommanditgesellschaft auf Aktien, Duesseldorf, Germany

[21] Appl. No.: 08/583,083

[22] PCT Filed: Jul. 12, 1994

[86] PCT No.: PCT/EP94/02285

§ 371 Date: Jan. 22, 1996

§ 102(e) Date: Jan. 22, 1996

[87] PCT Pub. No.: WO95/03389

PCT Pub. Date: Feb. 2, 1995

[30] Foreign Application Priority Data

Jul. 21, 1993 [DE] Germany ..... 43 24 396

[51] Int. Cl.[6] ..... C11D 3/33; C11D 3/20; C11D 10/04

[52] U.S. Cl. ..... 510/245; 510/404; 510/405; 510/421; 510/433; 510/434; 510/435; 510/436

[58] Field of Search ..... 510/245, 370, 510/404, 405, 421, 433, 434, 435, 436

[56] References Cited

U.S. PATENT DOCUMENTS

| | | | |
|---|---|---|---|
| 4,284,434 | 8/1981 | Lingmann et al. . | |
| 4,412,943 | 11/1983 | Hirota et al. . | |
| 4,745,103 | 5/1988 | Oono et al. | 514/23 |
| 5,415,813 | 5/1995 | Misselyn et al. | 510/365 |
| 5,486,307 | 1/1996 | Misselyn et al. | 510/365 |
| 5,552,089 | 9/1996 | Misselyn et al. | 510/417 |
| 5,573,702 | 11/1996 | Bonnechere et al. | 510/417 |
| 5,604,195 | 2/1997 | Misselyn et al. | 510/400 |

FOREIGN PATENT DOCUMENTS

| | | |
|---|---|---|
| 0303928 | 10/1991 | European Pat. Off. . |
| 0560322 | 9/1993 | European Pat. Off. . |
| 0497790 | 8/1994 | European Pat. Off. . |
| 2014883 | 10/1970 | Germany . |
| 1942236 | 3/1971 | Germany . |
| 1964792 | 7/1971 | Germany . |
| 2510245 | 9/1975 | Germany . |
| 2712900 | 10/1978 | Germany . |
| 3206350 | 9/1982 | Germany . |
| 3935374 | 4/1991 | Germany . |
| 4319578 | 12/1994 | Germany . |
| 4319798 | 12/1994 | Germany . |
| 3727378 | 1/1995 | Germany . |
| 2099599 | 4/1990 | Japan . |
| 2231580 | 5/1990 | United Kingdom . |
| WO 9201778 | 2/1992 | WIPO . |

*Primary Examiner*—Margaret Medley
*Attorney, Agent, or Firm*—Ernest G. Szoke; Wayne C. Jaeschke; Norvell E. Wisdom, Jr.

[57] ABSTRACT

Powdered, paste, or liquid media for cleaning and/or degreasing hard surfaces, especially surfaces of organic polymers (PVC) contain active ingredients of amino acids, carboxylic acids, and nonionic surfactants, possibly supplemented by action-reinforcing auxiliaries and/or demulsifying additives. Processes using these media are also claimed.

19 Claims, No Drawings

CLEANER WITH HIGH WETTING POWER

FIELD OF THE INVENTION

This invention relates to powder-form, paste-form or liquid formulations for cleaning and/or degreasing hard surfaces, for example metallic surfaces, but especially surfaces of organic polymers, for example paints and coatings, but especially surfaces of halogenated polyolefins, such as polyvinyl chloride. The formulations according to the invention are characterized by a combination of active substances consisting of amino acids, carboxylic acids or salts thereof and nonionic surfactants. The formulations may be used as industrial cleaners (as neutral cleaners or as alkaline cleaners) and for cleaning vehicles and plant.

STATEMENT OF RELATED ART

DE-A-27 12 900 describes a process for the spray cleaning of metals. This cleaning process is carried out at pH values of 7.5 to 11 and preferably at pH values of 8.5 to 10 using solutions containing A) soluble salts, preferably alkanolamine salts, of aromatic carboxylic acids and/or branched and/or straight-chain aliphatic carboxylic acids containing 6 to 12 carbon atoms, B) one or more nonionic surfactants, C) one or more surface-active quaternary ammonium compounds. The document does not contain any references to the possible use of amino acids in such cleaning formulations.

GB-A-2,23 1,580 describes cleaning formulations intended in particular for sanitary purposes. They have pH values of 6.0 to 8.0 and contain A) 0.1 to 20% by weight of an anionic and/or nonionic surfactant, B) hydroxycarboxylic acids or salts thereof, C) aminocarboxylic acids or salts thereof and D) 0.1 to 20% by weight of an alkylene glycol alkyl ether as solvent. It is apparent from the specification that the aminocarboxylic acids are not understood to be amino acids containing free $NH_2$ groups. Instead, aminocarboxylic acids in the context of this document are carboxylic acids containing a tertiary aminofunction, for example nitrilotriacetic acid or ethylenediamine tetraacetic acid.

DE-A-32 06 350 relates to a liquid cleaning mixture which has a suitable viscosity at the time of its application. It is intended in particular as a hair washing formulation. Its principal components consist of ammonium alkylsulfates, alkylenediamine carboxylic acid derivatives and 0.1 to 5% by weight of a carboxylic acid, a salt of the carboxylic acid, an amino acid or a salt of the amino acid. The carboxylic acid is selected from fatty acids containing 1 to 8 carbon atoms, dicarboxylic acids containing 2 to 7 carbon atoms, hydroxycarboxylic acids or unsaturated polybasic carboxylic acids. The amino acid may be selected from neutral amino acids, acidic amino acids, basic amino acids, hydroxyamino acids, imino acids or sulfur-containing amino acids. In a particularly preferred embodiment, the amino acids are glycine, alanine, valine, leucine, isoleucine, phenyl alanine, tryptophanic acid, sarcosine, beta-alanine, gamma-aminobutyric acid, epsilon-aminocaproic acid, glutamic acid, aspartic acid, cysteic acid, homocysteic acid, lysine, ornithine, arginine, serine, homoserine, tyrosine, threonine, proline, hydroxyproline, cystine, cysteine or methionine.

WO 92/01778 discloses a process for the production of a powder-form laundry detergent in which the acid form of an anionic surfactant is continuously neutralized with alkali metal hydroxide. This document is related to the present invention in the fact that an alpha-aminodicarboxylic acid selected from the group consisting of glutamic acid, aspartic acid, aminomalonic acid, aminoadipic acid and 2-amino-2-methylpentanedioic acid or salts thereof is added. Sodium glutamate is particularly preferred. Other optional constituents of the detergent mixture are nonionic, cationic, amphoteric or zwitterionic surfactants. The detergents in question may also contain carboxylates, $C_{10-18}$ alkyl monocarboxylates, i.e. soaps, being particularly mentioned.

DE-A-19 42 236 describes detergents, washing aids and cleaning formulations which have a particularly good dissolving effect on protein-containing soils by virtue of the fact that they contain sulfur-free amino acids containing 4 to 11 carbon atoms and optionally another carboxyl and/or amino group or salts of such acids. The preferred amino acids are glutamic acid, aspartic acid, histidine, arginine and lysine. In addition, the detergents preferably contain protein-splitting enzymes. Other ingredients of the detergents are the usual cleaning-active ingredients of detergents, washing aids and cleaning formulations, more particularly anionic and/or nonionic surfactants and builders. The active-substance combination according to the invention of amino acids, certain carboxylic acids and nonionic surfactants as described in the following and their special ratios are not anticipated by, or logical from, this document.

German patent application P 43 19 578.4 describes powder-form to granular laundry detergents which contain anionic and/or nonionic surfactants and zeolite and/or one or more silicates from the group of amorphous and crystalline, layer-form alkali metal silicates and which are characterized in that they additionally contain sulfur-free amino acids containing 2 to 11 carbon atoms and optionally another carboxyl and/or amino group and/or salts of such acids. The amino acids are preferably selected from glycine, alanine, valine, leucine, isoleucine and salts thereof. These detergents may additionally contain carboxylic acid derivatives in the form of peracids as bleaching agents or in the form of soaps as foam suppressors. $C_{12-24}$ fatty acid soaps are particularly preferred as soaps. Accordingly, these laundry detergents contain the typical detergent ingredients, zeolite and/or layer-form alkali metal silicates, which are known as builders.

German patent application P 43 19 798.1 discloses machine dishwashing detergents of which 1% by weight aqueous solutions have a pH value of 8 to 12 and preferably 9 to 11 and which contain water-soluble builder components and oxygen-based bleaching agents, being characterized in that they contain 0.5 to 60% by weight and preferably 10 to 50% by weight of one or more amino acids as alkali carriers. Alanine, valine, leucine, isoleucine and, above all, glycine are mentioned as amino acids. The function of these amino acids and their salts is to act as readily biodegradable alkali carriers.

DESCRIPTION OF THE INVENTION

Object of the Invention

The problem addressed by the present invention was to provide improved cleaning formulations for cleaning/degreasing technical surfaces, for example metallic surfaces, but especially plastic surfaces. Surfaces of non-polar plastics, for example surfaces of polyvinyl chloride (PVC) or polypropylene, are particularly difficult to clean and degrease on account of their comparatively poor wetting behavior. Accordingly, there is a need industry for improved cleaning formulations which are distinguished by increased wetting power on non-polar plastics. The object of the present invention was to provide such improved industrial cleaning/degreasing formulations.

SUMMARY OF THE INVENTION

The problem stated above has been solved by powder-form, paste-form or liquid formulations for cleaning and/or degreasing hard surfaces which contain a) 0.2 to 12% by weight of one or more aliphatic or aromatic monoamino- or di-aminomonocarboxylic or dicarboxylic acids or monoaminodicarboxylic acid monoamides corresponding to general formula (I):

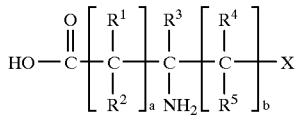

(I)

in which a and b independently of one another are integers from 0 to 6, $R^1$ at each carbon atom independently of one another may represent H, OH, $CH_3$ or $C_2H_5$, $R^2$ at each carbon atom independently of one another may represent H, $CH_3$ or $C_2H_5$, $R^3$ is H, $CH_3$ or $C_2H_5$, $R^4$ at each carbon atom independently of one another may represent H, OH, $CH_3$or $C_2H_5$, $R^5$ at each carbon atom independently of one another may represent H, $CH_3$ or $C_2H_5$, and X is hydrogen, a homocyclic or heterocyclic group, preferably phenyl, C(O)OH or $C(O)NH_2$ and, with the proviso that b>0, may also represent $NH_2$, NH—C(=NH)—$NH_2$, or NH—C(=O)—$NH_2$, or anions thereof, b) 1 to 12% by weight of one or more carboxylic acids containing 4 to 24 carbon atoms or anions thereof, c) 4 to 15% by weight of one or more nonionic surfactants, the balance to 100% by weight consisting of water and/or auxiliaries, preferably selected from builders, other surfactants, polymers and complexing agents.

The wording that the acids mentioned under a) and b) may be present as such or in the form of their anions means that these acids must be present in a water-soluble form, in that either they themselves show adequate solubility in water or are present in the formulation in the form of water-soluble salts. Suitable water-soluble salts are in particular the alkali metal salts, preferably the sodium salts, of these acids. In addition, the anions may be used as ammonium salts or as salts containing substituted ammonium ions. Preferred substituted ammonium ions are alkanolammonium ions.

DESCRIPTION OF PREFERRED EMBODIMENTS

Unbranched amino acids corresponding to formula (I) or derivatives thereof, i.e. compounds in which $R^1$ to $R^5$ are hydrogen, are preferably used. By virtue of their widespread natural occurrence, for example in proteins, and their ready availability, for example in the form of protein hydrolyzates, alpha-amino acids are preferably used. In formula (I), alpha-amino acids are symbolized by a=0. Among the possible alpha-amino acids, those which are not branched at the carbon atom bearing the amino group, i.e. in which the substituent $R^3$ in formula (I) is hydrogen, are preferred.

The naturally occurring alpha-amino acids or amino acid derivatives are generally chiral in relation to the carbon atom bearing the amino group and are present in the L form. Although the chiral L-amino acids do not afford any particular advantages for the technical application according to the invention, they are preferably used as natural or near-natural active substances.

Accordingly, the following amino acids, for example, may be used in the form of their racemates or in optically active form: glycine, alanine, valine, leucine, isoleucine, phenyl alanine, tryptophanic acid, sarcosine, beta-alanine, gamma-aminobutyric acid, ϵ-aminocaproic acid, glutamine, glutamic acid, aspartic acid, lysine, ornithine, arginine, serine, homoserine, tarosine, threonine, proline, hydroxyproline, aminomalonic acid, aminoadipic acid and 2-amino-2-methylpentanedioic acid. Particularly good results are obtained with glutamic acid.

Instead of the amino acids or their salts, the formulations may also contain amino acid precursors which can be converted into the amino acids under the in-use conditions of the cleaning bath. Corresponding amino acid precursors are, for example, oligopeptides or protein hydrolyzates, lactams, such as ϵ-caprolactam for example, or anhydrides of polybasic amino acids.

The carboxylic acids of group b) may be represented by general formula (II):

$$R^6—COOH \quad (II)$$

in which $R^6$ is an aliphatic, linear or branched hydrocarbon radical containing 3 to 23 carbon atoms and 0 to 5 double bonds, preferably 5 to 9 carbon atoms and 0 or 1 double bond. The saturated carboxylic acids hexanoic acid (caproic acid), octanoic acid (caprylic acid) and decanoic acid (capric acid) are particularly preferred. Branched saturated carboxylic acids, more particularly 2-ethyl hexanoic acid, 3,5,5-trimethyl hexanoic acid and 2,2-dimethyl octanoic acid, also afford particular technical advantages.

In addition, carboxylic acids corresponding to general formula (II) may also be those in which $R^6$ is an $R^7C_6H_4$—C(O)—CH=CH— group, where $R^7$ is a linear or branched $C_{8-14}$ alkyl radical.

The nonionic surfactants of group c) are selected from the group of ethoxylated and/or ethoxylated and propoxylated fatty alcohols corresponding to general formula (III):

$$R^8—O—(EO)_x—(PO)_y—H \quad (III)$$

in which $R^8$ is a linear or branched alkyl radical containing 6 to 14 carbon atoms, preferably 8 to 12 carbon atoms and, more preferably, 8 carbon atoms, x is a number of 2 to 10, y is a number of 0 to 8, EO is a —$CH_2$—$CH_2$—O— group and PO is a —CH($CH_3$)—$CH_2$—O— group.

The nonionic surfactants selected must satisfy legal requirements (Detergents Act) in regard to their biodegradability. To limit the tendency of the cleaning formulations towards foaming, it is recommended that the cloud points of the nonionic surfactants should be below the intended working temperatures of 10 to 70° C. The tendency of the cleaning solutions towards foaming can be further suppressed by additions of so-called mixed ethers, even at low working temperatures, for example at temperatures of 10 to 25° C. The mixed ethers in question are end-capped ethoxylation products of fatty alcohols corresponding to the general formula R'—O—$(EO)_n$—R", in which R' is a $C_{6-18}$ alkyl or alkenyl radical, R" is a $C_{4-8}$ alkyl radical and n is a number of 2 to 6. The homolog distribution of the EO chain may be conventional or narrow. Corresponding products and the effective quantities in which they are used (10–2500 ppm, preferably 50–500 ppm in the ready-to-use cleaning solution) are described in detail, for example, in DE-A-37 27 378 and DE-A-39 35 374.

The composition of the formulations according to the invention is preferably adjusted in such a way that they contain the amino acids or amino acid derivatives from group a) or anions thereof in quantities of 0.4 to 4% by weight and/or the carboxylic acids from group b) or anions thereof in quantities of 2 to 7% by weight and/or the nonionic surfactants from group c) in quantities of 5 to 10% by weight.

Depending on the particular presentation envisaged, the cleaners may be formulated as aqueous concentrates, as pumpable pastes or as powders. In the case of aqueous concentrates, solutions of the constituents according to the invention from groups a), b) and c) in the above-mentioned quantities in water are prepared in the most simple case. In addition, however, the aqueous concentrates may contain other auxiliaries typically encountered in cleaning formulations, such as for example builders, other surfactants, polymers and/or complexing agents.

Where the cleaners are formulated as powders, the auxiliaries mentioned are added in powder form to the active-substance combination according to the invention of groups a), b) and c) in such quantities that the mixture as a whole contains the active substances of groups a), b) and c) in the quantitative ranges mentioned.

Pastes contain the active substances of groups a), b) and c) in the quantitative ranges mentioned in addition to liquid or solid auxiliaries from the above-mentioned groups and water in such a quantity that a pumpable paste is formed.

Depending on the absence or presence of active substances or auxiliaries which show a strongly alkaline reaction in aqueous solution, the formulations according to the invention fall into the group of neutral cleaners or represent alkaline cleaners.

In Römpp's *Chemie Lexikon,* neutral cleaners are defined as cleaners of which 0.5 to 2% aqueous solutions have a pH value in the range from about 6 to 9.5. At higher pH values, the cleaners are classified as alkaline cleaners.

In many industrial applications, it is desirable that the cleaning solution exhibit demulsifying properties. This means that, although oily soils are removed very easily from the surfaces to be degreased, they do not form a stable emulsion in the aqueous cleaning solution, but instead float on the water-based cleaning formulation as an oily phase at the working temperature or even after temperature adaptation and/or dilution. The oil phase may then readily be removed from the cleaning solution so that the useful life of the cleaning bath can be considerably extended. The demulsifying properties of the cleaning/degreasing formulations according to the invention are particularly apparent when the cleaning solutions are diluted. In cases where self-emulsifying oils containing anionic emulsifiers are introduced, they are maintained or improved by the fact that the formulations contain cationic surfactants, betaines and/or cationically modified polymers in quantities of 0.01 to 3% by weight.

Suitable cationic surfactants are ammonium compounds corresponding to formula (IV):

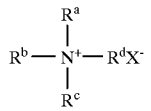

(IV)

which contain one, two or three unsubstituted or hydroxyl-substituted linear or even branched carbon chains. Ammonium compounds corresponding to the general formula $R^aR^bR^cR^dN^+X^-$, in which at least one and preferably two of the substituents R are unsubstituted or optionally hydroxyl-substituted $C_{1-2}$ alkyl radicals and at least one of the remaining substituents R is an unsubstituted or optionally 2-hydroxyl-substituted linear or branched alkyl group containing at least 10 carbon atoms and the anion X is selected from the group consisting of hydroxide, chloride, bromide, sulfate, nitrate, phosphate, preferably borate, are preferably used.

Ammonium salts in which $R^a$ and $R^b$ are methyl, $R^c$ is methyl, 2-hydroxyethyl, benzyl, 2-hydroxydodecyl or 2-hydroxyhexadecyl and $R^d$ is 2-hydroxydodecyl, 2-hydroxyhexadecyl, lauryl, hexadecyl or stearyl, are particularly suitable cationic surfactants.

In addition, compounds corresponding to the general formula $R^aR^bR^cR^dN^+X^-$, in which $R^a$, $R^b$ and $R^c$ are (ethylene oxide)$_n$ groups, where n=1–6, $R^d$ is a $C_{10-20}$ alkyl radical and X represents anions from the group consisting of carboxylate, more particularly benzoate, hydroxide, chloride, bromide, sulfate, nitrate, phosphate, preferably borate, are used as cationic surfactants.

Alkyl pyridinium salts corresponding to the general formula $C_5H_5N^+$—$RX^-$, in which R is a $C_{10-20}$ and preferably $C_{12-16}$ alkyl radical and X represents anions from the group consisting of carboxylate, more particularly benzoate, hydroxide, chloride, bromide, sulfate, nitrate, phosphate, preferably borate, are also used as cationic surfactants.

In principle, any nitrogen-containing polymers which may either be cationically modified by protonation or alkylation, generally methylation, of the nitrogen or converted into the corresponding ammonium salts may be used as cationic polymers or cationically modified polymers. The degree of cationic modification is variable and depends upon the neutral starting polymer, the corresponding acid used for protonation or the corresponding alkylating agent.

Examples of cationic polymers which may be used in the formulation according to the invention either on their own or together with cationic surfactants are protonated quaternary acrylamides, N,N-dialkylaminoalkyl acrylates, dialkylamines or vinyl pyridine and methylated quaternary polymers, such as poly{diallyl dimethylammonium chloride} or poly-{N-methyl vinyl pyridinium chloride}.

The molecular weights of the cationic polymers used in the formulation according to the invention are between $5\times10^4$ and $5\times10^7$ and preferably between $7.5\times10^4$ and $5\times10^6$. Protonated polyethyleneimine (25% AS), methylated polyethyleneimine (25% AS) or protonated N,N-dimethylaminoethyl acrylate/acrylamide copolymer (100% AS) are preferably used (AS=active substance).

The addition of suitable complexing agents can further improve the performance of the formulations according to the invention where they are made up with hard water or where they are applied to surfaces containing metal-containing impurities. Accordingly, the invention also encompasses formulations containing one or more complexing agents selected from at least one of the groups d) hydroxypolycarboxylic acids, e) nitrogen-containing mono- or polycarboxylic acids, f) mono- or diphosphonic acids, g) aminophosphonic acids, h) phosphonopolycarboxylic acids and also water-soluble salts, preferably sodium, potassium or ammonium salts, of the acids of groups d) to h) in quantities, based on the free acids, of 0.01 to 15% by weight.

Suitable complexing agents are known in large numbers. They may belong to different chemical groups. The following are preferably used either individually or in admixture with one another:

d) hydroxypolycarboxylic acids, such as tartaric acid and citric acid, e) nitrogen-containing mono- or poly-carboxylic acids, such as ethylenediamine tetraacetic acid ("EDTA"), N-hydroxyethyl ethylenediamine triacetic acid, diethylenetriamine pentaacetic acid, hydroxyethyl iminodiacetic acid, nitrilodiacetic acid-3-propionic acid, isoserine diacetic acid, N,N-di-(β-hydroxyethyl)-glycine, N-(1,2-dicarboxy-2-hydroxyethyl)-glycine, N-(1,2-dicarboxy-2-hydroxyethyl)-aspartic acid or nitrilotriacetic acid ("NTA"), f) monophosphonic acids containing 1 to 10 carbon atoms, geminal diphosphonic acids, such as 1-hydroxyethane-1,1-diphosphonic acid (HEDP), higher homologs thereof containing up to 8 carbon atoms and hydroxyfunctional or aminofunctional derivatives thereof and 1-aminoethane-1,1-diphosphonic acid, higher homologs containing up to 8 carbon atoms and hydroxyfunctional or aminofunctional derivatives thereof, g) aminophosphonic acids, such as ethylenediamine tetra (methylenephosphonic acid), diethylenetriamine penta (methylenephosphonic acid) or nitrilotri (methylenephosphonic acid) and h) phosphonopolycarboxylic acids, such as 2-phosphonobutane-1,2,4-tricarboxylic acid.

The detergents according to the invention may be used without further alkaline builders. However, for demanding cleaning tasks, it is advisable to enhance the cleaning effect by the incorporation of alkaline builders. The builders normally used for alkaline cleaners are suitable for this purpose. Accordingly, the formulations according to the invention also include those which contain one or more builders selected from at least one of the groups i) mono-, di- or tri-ethanolamine or cations thereof, k) alkali metal hydroxides, l) silicates, preferably metasilicates, m) carbonates, n) oligo- or poly-carboxylates, o) ortho- or poly-phosphates, p) borates, in quantities of 0.01 to 94.8% by weight, the anions of groups l) to p) being present in the form of their water-soluble salts, preferably ammonium or alkali metal salts, more particularly as Li, Na or K salts.

The present invention also relates to processes for cleaning and/or degreasing hard surfaces, characterized in that the surfaces are contacted with 2 to 50% by weight aqueous solutions of the formulations by immersion or spraying at temperatures of 10 to 70° C.

The concentrations best established or the dilutions selected depend on whether the formulations according to the invention are used as powders, as pastes rich in active substances or as more or less highly concentrated aqueous concentrates. 2 to 10% by weight aqueous solutions are preferably used in the case of powders, 2 to 15% by weight aqueous solutions are preferably used in the case of pastes and 5 to 15% by weight aqueous solutions are preferably used in the case of liquid formulations.

It is well known in the field of industrial cleaners that nonionic surfactants can be combined with anionic surfactants. Accordingly, the present invention also encompasses processes in which, in addition to the formulations according to the invention, the aqueous cleaning solution additionally contains one or more anionic surfactants selected from at least one of the groups q) alkyl sulfates with a linear or branched $C_{10-18}$ alkyl group, r) alkyl polyglycol ether sulfates with a linear or branched $C_{10-18}$ alkyl group and 1 to 6 —$CH_2$—$CH_2$—O— groups in the molecule, s) alkylaryl sulfonates with an alkyl benzene group containing a linear or branched $C_{7-9}$ alkyl group, in quantities of 0.01 to 3% by weight, the surfactant anions preferably being present in the form of alkali metal salts, more particularly sodium salts.

The cleaning/degreasing formulations and cleaning processes according to the invention may generally be used in the field of industrial cleaning, including the cleaning of vehicles and plant. Their advantage of high wetting power is particularly apparent when the surfaces to be degreased are surfaces of organic polymers. Examples of such surfaces are painted surfaces or surfaces of polycarbonates or polyurethanes. In addition, surfaces of non-polar plastics, for example of polyolefins, and preferably surfaces of halogenated polyolefins and, more particularly, polyvinyl chloride are also particularly worth mentioning.

EXAMPLES

The cleaners were formulated as powders or as liquid aqueous concentrates in deionized water (Examples 1 to 3). To prepare the degreasing baths, the powders or concentrates were dissolved or diluted with municipal water (hardness 18° d) to the concentrations shown in the Tables.

The cleaning/degreasing effect of the formulations according to the invention and of comparison formulations was tested on tiles of PVC (=polyvinyl chloride). To this end, the sample tiles were first cleaned with a commercial cleaner and then coated with a mineral test oil. The oil-covered PVC tiles were then hung in cleaning solutions according to Tables 1 to 3 at room temperature and the time required to achieve complete wetting was evaluated. The shortest time for each group of formulations (=each Table) was put at 100% and the longer wetting times were related thereto. If thorough wetting had not occurred after a maximum observation time of 4 hours, the test was terminated. Cases such as these are identified by "---" in the Tables.

The Examples from each group identified as the fastest wetting formulations according to these tests, namely Examples 4, 8 and 12, and corresponding amino acid-free Comparison Examples were tested relative to one another in regard to their wetting times under various application conditions. The shortest wetting time was put at 100%. The results are set out in Table 4.

Examples 1–3

Powder products and liquid concentrates

Cleaning/degreasing formulations according to the invention with the following composition (in % by weight) were prepared:

| | |
|---|---|
| Example 1 (powder): | |
| Trisodium nitrilotriacetate | 13.8 |
| Sodium metasilicate | 15.0 |
| Sodium carbonate | 41.2 |
| 3,5,5-Trimethylhexanoic acid | 10.0 |
| L-Glutamic acid | 10.0 |
| Octanol × 3.5 EO × PO | 10.0 |
| Example 2 (aqueous concentrate): | |
| Triethanolamine | 18.2 |
| Sodium carbonate | 2.0 |
| 2-Ethylhexanoic acid | 8.5 |
| L-Glutamic acid | 1.3 |
| Octyl phosphonic acid | 1.0 |
| Nitrilotri-(methylenephosphonic acid) | 3.0 |
| Sodium hydroxide | 6.5 |

-continued

| | |
|---|---|
| $C_{10/12}$ Alcohol mixture × 6 EO × 8 PO | 7.0 |
| Water | 52.5 |
| Example 3 (aqueous concentrate) | |
| Trisodium nitrilotriacetate | 6.5 |
| Cocoalkyl dimethylammonium betaine | 1.4 |
| 2,2-Dimethyl octanoic acid | 1.5 |
| L-Glutamic acid | 0.5 |
| Octanol × 3.5 EO × 2 PO | 2.9 |
| Octanol × 4.7 EO | 5.5 |
| Water | 81.7 |

TABLE 3

Cleaning solutions III Compositions in % by weight

| | Example 12* | Comp. 5 | Comp. 6 |
|---|---|---|---|
| Water | 97.44 | 97.44 | 97.44 |
| Trisodium nitrilotriacetate | 0.91 | 0.91 | 0.91 |
| Cocoalkyl dimethylammonium betaine | 0.20 | 0.20 | 0.20 |
| 2,2-Dimethyl octanoic acid | 0.21 | — | 0.21 |

TABLE 1

Cleaning solutions I Composition in % by weight

| | Example 4* | Example 5 | Example 6 | Example 7 | Comp. 1 | Comp. 2 |
|---|---|---|---|---|---|---|
| Trisodium nitrilotriacetate | 0.97 | 0.97 | 0.97 | 0.7 | 0.97 | 0.97 |
| Sodium metasilicate | 1.05 | 1.05 | 0.7 | 1.4 | 1.4 | 1.4 |
| Sodium carbonate | 2.88 | 2.88 | 2.18 | 3.15 | 3.23 | 3.23 |
| Trisodium orthophosphate | — | — | 1.05 | — | — | — |
| 3,5,5-Trimethyl hexanoic acid | 0.7 | — | 0.7 | 0.49 | — | 0.7 |
| Octanoic acid | — | 0.7 | — | — | — | — |
| Aminopentane-dioic acid (L-glutamic acid) | 0.7 | — | — | 0.35 | 0.7 | — |
| Gamma-aminobutyric acid | — | 0.7 | — | — | — | — |
| Glycine | — | — | 0.7 | — | — | — |
| Octanol × 3.5 EO × 2 PO | 0.7 | 0.7 | 0.7 | 0.91 | 0.7 | 0.7 |
| Water | 93 | 93 | 93 | 93 | 93 | 93 |
| Degreasing time (%) | 100 | 100 | 110 | 130 | 200 | 180 |

*7% by weight solution of the cleaning powder of Example 1

TABLE 2

Cleaning solutions II Compositions in % by weight

| | Example 8* | Example 9 | Example 10 | Example 11 | Comp. 3 | Comp. 4 |
|---|---|---|---|---|---|---|
| Water | 93.35 | 93.35 | 93.35 | 93.35 | 93.35 | 94.57 |
| Triethanolamine | 2.55 | 2.55 | 2.55 | 2.55 | 2.55 | 2.55 |
| Sodium carbonate | 0.28 | 0.28 | 0.28 | 0.28 | 0.28 | 0.56 |
| 2-Ethyl hexanoic acid | 1.19 | 1.19 | 1.19 | 1.19 | 1.19 | — |
| Aminopentanedioic acid (L-glutamic acid) | 0.18 | — | — | — | — | 0.18 |
| L-Aspartic acid | — | 0.18 | — | — | — | — |
| L-Asparagine | — | — | 0.18 | — | — | — |
| L-Arginine | — | — | — | 0.18 | — | — |
| Octyl phosphonic acid | 0.14 | 0.14 | 0.14 | 0.14 | 0.14 | 0.14 |
| Nitrilotri-(methylene phosphonic acid) | 0.42 | 0.42 | 0.42 | 0.42 | 0.42 | 0.42 |
| Sodium hydroxide | 0.91 | 0.91 | 0.91 | 0.91 | 0.91 | 0.42 |
| $C_{10/12}$ Alcohol mixture × 6 EO × 8 PO | 0.98 | 0.98 | 0.98 | 0.98 | 1.16 | 1.16 |
| Degreasing time (%) | 100 | 110 | 120 | 120 | 220 | — |

*14% by weight solution of the concentrate of Example 2

TABLE 3-continued

Cleaning solutions III Compositions in % by weight

| | Example 12* | Comp. 5 | Comp. 6 |
|---|---|---|---|
| Aminopentanedioic acid (L-glutamic acid) | 0.07 | 0.07 | — |
| Octanol × 3.5 EO × 2 PO | 0.41 | 0.41 | 0.41 |
| Octanol × 4.7 EO | 0.76 | 0.97 | 0.83 |
| Degreasing time (%) | 100 | 170 | 150 |

*)14% by weight solution of the concentrate of Example 3

TABLE 4

Application variations of the solutions of Tables 1 to 3

| Test substance | Method of application | Temperature (°C.) | Degreasing time (%) |
|---|---|---|---|
| Example 4 | Spraying | 60 | 100 |
| Example 4 | Dipping | 50 | 120 |
| Example 4 | Dipping | 20 | 150 |
| Example 8 | Spraying | 60 | 120 |
| Example 8 | Spraying | 40 | 130 |
| Example 8 | Dipping | 60 | 150 |
| Example 12 | Dipping | 60 | 110 |
| Comparison 2 | Spraying | 60 | 190 |
| Comparison 3 | Spraying | 60 | 220 |
| Comparison 6 | Spraying | 60 | 170 |

The invention claimed is:

1. Powdered, past or liquid formulations for cleaning, degreasing, or both cleaning and degreasing hard surfaces, said formulations comprising:

a) 0.2 to 12% by weight of compounds selected from the group consisting of:

a.1) amino acids corresponding to general formula (I):

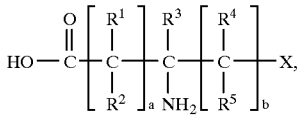

(I)

wherein:

a and b, independently of one another, are integers from 0 to 6;

$R^1$ at each carbon atom, independently of one another, represents H, OH, $CH_3$ or $C_2H_5$;

$R^2$ at each carbon atom, independently of one another, represents H, OH, $CH_3$ or $C_2H_5$;

$R^3$ is H, $CH_3$ or $C_2H_5$;

$R^4$ at each carbon atom, independently of one another, represents H, OH, $CH_3$ or $C_2H_5$;

$R^5$ at each carbon atom, independently of one another, represents H, $CH_3$ or $C_2H_5$; and if b is zero, X is hydrogen, a homocyclic or heterocyclic group, C(O)OH, or $C(O)NH_2$; while b is greater than zero, X is hydrogen, a homocyclic or heterocyclic group, C(O)OH, $C(O)NH_2$, $NH_2$, NH—C(=NH)—$NH_2$, or NH—C(=O)—$NH_2$;

a.2) anions of amino acids recited in part a.1); and a.3) amino acid derivatives selected from the group consisting of oligopeptides, protein hydrolyzates and lactams or anhydrides of polybasic amino acids that convert to amino acids as recited in part a.1) under the conditions of cleaning;

b) 1 to 12% by weight of one or more carboxylic acids corresponding to general formula (II):

$$R^6—COOH \quad (II)$$

in which $R^6$ is an aliphatic, linear or branched hydrocarbon radical containing 5 to 9 carbon atoms and 0 to 1 double bond or an $R^7—C_6H_4—C(O)—CH=CH—$ group, where $R^7$ is a linear or branched $C_{8-14}$ alkyl radical, or anions thereof, c) 4 to 15% by weight of one or more nonionic surfactants that are selected from the group consisting of molecules that conform to general formula (III):

$$R^8—O—(EO)_x—(PO)_y—H \quad (III)$$

in which:

$R^8$ is a linear or branched alkyl radical containing 6 to 14 carbon atoms;

x is a number from 2 to 10;

y is a number from 0 to 8;

EO is a $—CH_2—CH_2—O—$ group; and

PO is a $—CH(CH_3)—CH_2—O—$ group, the balance to 100% by weight being selected from the group consisting of water, builders, other surfactants, polymers and complexing agents.

2. The formulations as claimed in claim 1, wherein, in the general formula (I) of the amino acids or amino acid derivatives of group a), $R^1$, $R^2$, $R^3$, $R^4$ and $R^5$ each represent hydrogen.

3. The formulations as claimed in claim 1, wherein, in general formula (I), a=0.

4. The formulations as claimed in claim 3, wherein, in general formula (I), $R^3$ is hydrogen.

5. The formulations as claimed in claim 1, wherein the amino acids or amino acid derivatives corresponding to general formula (I) are chiral in relation to the carbon atom bearing the amino group and are present in the L form.

6. The formulations as claimed in claim 1, wherein additionally contain a total of 0.01 to 94.8% by weight of one or more builders selected from the group consisting of i) mono, di- and tri-ethanolamine and cations thereof, k) alkali metal hydroxides, l) silicates, m) carbonates, n) oligo- and poly-carboxylates, o) ortho- and poly-carboxylates, ortho- and poly-phosphates, and borates being in the form of their water-soluble salts.

7. The formulations as claimed in claim 1, wherein the amino acid of group a) is glutamic acid.

8. The formulations as claimed in claim 1, which contain at least one of:

the amino acids or amino acid derivates from group a) or anions thereof in quantities of 0.4 to 4% by weight; and the carboxylic acids from group b) or anions thereof in quantities of 2 to 7% by weight; and the nonionic surfactants from group c) in quantities of 5 to 10% by weight.

9. The formulations as claimed in claim 1, which additionally contain a total of 0.01 to 3% by weight of materials selected from the group consisting of cationic surfactants, betaines and cationically modified polymers.

10. The formulations as claimed in claim 1, which additionally contain a total of from 0.01 to 15% by weight of one or more complexing agents selected from the group consisting of: d) hydroxypolycarboxylic acids, e) nitrogen-containing mono- or poly-carboxylic acids, f) mono- or di-phosphonic acids, g) aminophosphonic acids, h) phosphonopolycarboxylic acids, and water-soluble salts of the acids of groups d) to h).

11. A process for cleaning, degreasing, or both cleaning and degreasing hard surfaces, wherein the hard surfaces are contacted with 2 to 50% by weight aqueous solutions of the formulations claimed in claim 6 by immersion or spraying at temperatures of 10 to 70° C.

12. The formulations as claimed in claim 1, which additionally contain 0.05 to 14.5% by weight of mixed ethers corresponding to the general formula R'—O—$(EO)_n$—R", where R' is a $C_{6-18}$ alkyl or alkenyl radical, R" is a $C_{4-8}$ alkyl radical and n is a number of 2 to 6.

13. A process for cleaning, degreasing, or both cleaning and degreasing hard surfaces, wherein the hard surfaces are contacted with 2 to 50% by weight aqueous solutions of the formulations claimed in claim 7 by immersion or spraying at temperatures of 10 to 70° C.

14. A process for cleaning, degreasing, or both cleaning and degreasing hard surfaces, wherein the hard surfaces are contacted with 2 to 50% by weight aqueous solutions of the formulations claimed in claim 1 by immersion or spraying at temperatures of 10 to 70° C.

15. The process as claimed in claim 14, wherein 2 to 10% by weight aqueous solutions are used with powders, 2 to 15% by weight aqueous solutions are used with pastes and 5 to 15% by weight aqueous solutions are used in the case of liquid formulations.

16. The process as claimed in claim 14, wherein the aqueous cleaning solution additionally contains a total of 0.01 to 3% by weight of one or more anionic surfactants selected from the group consisting of q) alkyl sulfates with a linear or branched $C_{10-18}$ alkyl group, r) alkyl polyglycol ether sulfates with a linear or branched $C_{10-18}$ alkyl group and 1 to 6 —$CH_2$—$CH_2$—O— groups in the molecule, s) alkylaryl sulfonates with an alkyl benzene group containing a linear or branched $C_{7-9}$ alkyl group.

17. The process as claimed in claim 14, wherein the hard surfaces are surfaces of organic polymers.

18. The process according to claim 17, wherein the hard surfaces are painted surfaces or surfaces of polycarbonates, polyurethanes, polyolefins, or polyvinyl chloride.

19. The process as claimed in claim 16, wherein the surfactant anions are present in the form of sodium salts.

* * * * *